United States Patent [19]

Ikuta et al.

[11] Patent Number: 4,919,207

[45] Date of Patent: Apr. 24, 1990

[54] METHOD FOR DRAWING UP SPECIAL CRUDE OIL

[75] Inventors: Yoshiaki Ikuta; Masayuki Moriwaki, both of Tokyo; Masato Kaneko, Hiroshima, all of Japan

[73] Assignee: Mitsubishi Jukogyo Kabushiki Kaisha, Tokyo, Japan

[21] Appl. No.: 354,457

[22] Filed: May 22, 1989

Related U.S. Application Data

[63] Continuation of Ser. No. 65,786, Jun. 24, 1987, abandoned.

[30] Foreign Application Priority Data

Jun. 25, 1986 [JP] Japan ..... 61-146835

[51] Int. Cl.[5] ..... E21B 43/40

[52] U.S. Cl. ..... 166/267; 166/369

[58] Field of Search ..... 166/265, 267, 304, 310, 166/369

[56] References Cited

U.S. PATENT DOCUMENTS 4,501,445 2/1985 Gregoli ..... 166/267 X 4,697,426 10/1987 Knowles, Jr. ..... 166/267 X

*Primary Examiner*—William P. Neuder

*Attorney, Agent, or Firm*—McAulay Fisher Nissen & Goldberg

[57] ABSTRACT

The present invention is directed to a method for drawing up a special crude oil which is characterized by comprising the steps of extracting and separating a gas oil from a crude oil containing a great deal of wax or a high-viscosity crude oil which has been drawn up through an oil well, and drawing up the crude oil containing a great deal of wax or the high-viscosity crude oil, while injecting a part of the thus separated gas oil into the oil well. For the extraction and separation of the gas oil, a recycle oil is employed.

5 Claims, 1 Drawing Sheet

METHOD FOR DRAWING UP SPECIAL CRUDE OIL

This is a continuation of application Ser. No. 065,786, filed June 24, 1987, now abandoned.

FIELD OF THE INVENTION AND RELATED ART STATEMENT

The present invention relates to a method for drawing up a special crude oil such as a crude oil containing a large amount of wax or a high-viscosity crude oil.

A conventional drawing means for a special crude oil will be described in reference to FIG. 2 attached hereto.

A special crude oil is drawn up from an oil well through a pipe line 3 by means of an oil drawing system composed of a casing 5 and a tubing 6. In this case, many problems are posed. For example, as the special crude oil is lifted from an oil layer 4 and as its temperature thus falls, the tubing 6 tends to clog. For the prevention of the clogging, while the crude oil is drawn up, a crude gas oil is injected into the oil well through a line 2, or alternatively the clogged materials are removed therefrom mechanically.

However, in the case that in drawing up the special crude oil, the crude gas oil is injected thereinto for the purpose of lowering its pour point, there is the problem that the crude gas oil is not always available and cannot be fed thereto on occasion.

OBJECT AND SUMMARY OF THE INVENTION

The present invention intends to provide a method for drawing up a special crude oil by which the above mentioned problem can be solved.

According to the present invention, the above mentioned problem can be solved by combining a drawing system with an extraction/separation process of the special crude oil in drawing up the special crude oil.

That is, the present invention is directed to a method for drawing up a special crude oil which is characterized by comprising the steps of extracting and separating a gas oil from a crude oil containing a great deal of wax or a high-viscosity crude oil which has been drawn up through an oil well, and drawing up the crude oil containing a great deal of wax or the high-viscosity crude oil, while injecting a part of the thus separated gas oil into the oil well.

According to the present invention, since the gas oil which is extracted and separated from the special crude oil produced through the oil well is employed as the gas oil to be injected into the oil well, the miscibility between the special crude oil and the gas oil is good, thereby facilitating the drawing operation.

Further, by suitably selecting operative conditions of a separation process and by controlling properties of the gas oil to be injected, an amount of the gas oil can be decided arbitrarily in a system, and a mixing ratio between the special crude oil and the gas oil can be chosen optionally. In consequence, a pour point of the mixed oil can be determined freely between pour points of the special crude oil and the gas oil.

DETAILED DESCRIPTION OF PREFERRED EMBODIMENTS

The present invention will be described in detail in reference to FIG. 1.

Figure 1:
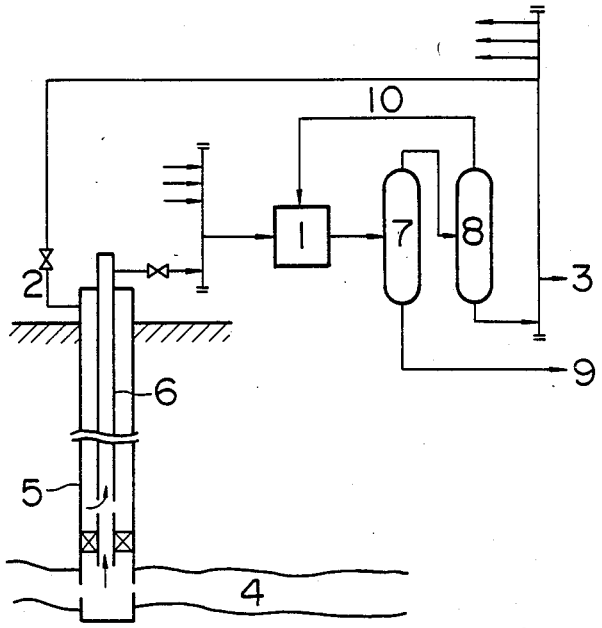
FIG. 1 is an explanatory view showing one embodiment of the present invention.
Figure 2:
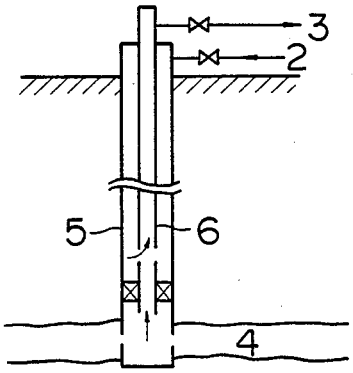
FIG. 2 is an explanatory view regarding a conventional drawing system of a crude oil.

In FIG. 1, the same reference numerals as in FIG. 2 represent the same members therein. Reference numerals 1, 7 and 8 represent an extraction/separation process section which is a feature of the present invention.

In the extraction/separation process, a special crude oil produced from an oil layer 4 by a drawing system (a casing 5 and a tubing 6) can be extracted and separated into a gas oil having a low pour point and a heavy oil.

From a pipe line 3 through which the treated oil separated in the extraction/separation process is transported, an injection line 2 branches. The latter 2 is connected to the casing 5 in the drawing system. While the extracted and separated gas oil is being injected through the injection line 2 into the oil well, the special crude oil is drawn up.

Now, in reference to FIG. 1, the function of the extraction/separation process will be described.

The drawn special crude oil is mixed with a recycle oil 10 in a mixer 1, and the resulting mixture is then introduced into a separating tank 7, in which the gas oil is separated from a heavy oil 9. The aforesaid recycle oil 10 has a function of extracting the gas oil and is thus also referred to as an extractant oil. The mixed oil of the gas oil and the recycle or extractant oil 10 is further delivered to a separating tank 8, in which the gas oil 3 is then separated from the recycle oil 10, which will be recycled afterward. At this time, when a temperature in the separating tank 8 is raised, a specific gravity of the recycle oil becomes as low as about a second or a third of its original level, so that a difference of the specific gravity between the recycle oil and the gas oil becomes great and a solubility of the gas oil becomes low. In consequence, the separability of the gas oil from the recycle oil is improved.

A part of the gas oil 3 is forwarded, as a dilute oil to be injected, to the casing 5 through the line 2.

The recycle or extractant oil usable in the present invention is that which comprises at least one of aromatic hydrocarbons having a normal boiling point of 150° C. or less, straight-chain hydrocarbons having 3 to 9 carbon atoms, and monoolefin hydrocarbons having 4 to 8 carbon atoms.

The mixer 1 used in the present invention may have a conventional structure. In the mixer 1, the recycle oil is mixed with the special crude oil, and in this case, an amount of the recycle oil is 0.05 to 12 times as much as that of the special crude oil.

In the extraction/separation tank 7, a pressure is maintained generally at a level of 0 to 200 kg/cm$^2$G, preferably 0 to 100 kg cm$^2$G and a temperature is maintained at a level of 0° to 450° C.

The usable separating tank 8 may have a conventional structure.

When the separating tank 8 is operated at a higher temperature than the extraction/separation tank 7, and when a part of the recycle or extractant oil is poured into the separating tank 8 in compliance with the separation efficiency of the separating tank 8, the separation of the gas oil from the recycle oil can be carried out in succession under the improved separation conditions.

EMBODIMENT

A specific crude oil containing a large amount of wax, properties of which were set forth in Table 1, was subjected to an extraction and separation treatment in an extraction/separation tank 7 under the conditions that a pressure was 60 kg/cm$^2$G, a temperature was 150° C., propane was used as a recycle or extractant oil, and a ratio of the recycle oil to the specific crude oil was 3.0. The properties of a separated gas oil are also set forth in Table 1.

TABLE 1

Comparison of Properties between Crude Oil and Separated Gas Oil

| Component (wt %) | Crude Oil before Treatment | Separated Gas Oil |
|---|---|---|
| Naphtha ($C_3$-170° C.) | 6.3 | 40.0 |
| Kerosine (170-232° C.) | 4.3 | 23.0 |
| Gas Oil (232-343° C.) | 14.2 | 32.0 |
| Gas Oil under Reduced Pressure (343-500° C.) | 34.0 | 3.0 |
| Residual Oil under Reduced Pressure (500° C. or more) | 41.2 | 2.0 |
| [Pour Point (°C.) | 57.5 | −10.5] |

As is definite from the results in Table 1, the extracted and separated gas oil had a noticeably low pour point.

When the crude oil having a pour point of 57.5° C. and the extracted and separated gas oil having a pour point of −10.5° C. in Table 1 were mixed with each other, the resulting mixed oil had a pour point of 30° C. This pour point of the mixed oil was lower than a mixed gas of the crude oil and another gas oil having a similar pour point. This indicates the predominacy of the present invention in drawing up the crude oil containing a great deal of wax.

For a high viscosity crude oil, a similar operation was carried out, and the obtained results are about the same as above.

The drawing method of the present invention can provide the following effects:

(1) Since the gas oil which is extracted and separated from the special crude oil produced through the oil well is employed as the gas oil to be injected into the oil well, the miscibility between the special crude oil and the gas oil is good, thereby facilitating the drawing operation.

(2) Regarding the group of the extraction/separation process section 1, 7 and 8, the line 2, the casing 5 and the tubing 6 in FIG. 1 as one system, the circulation of the injection gas oil through the line 2 is an internal circulation in this system. Therefore, even if a flow rate of the gas oil through the line 2 is changed, the operative conditions of the process are not affected. That is, an injection amount of the gas oil can be changed in compliance with a production of the crude oil through the oil layer 4 without altering the conditions of the process, which fact can facilitate the operation.

We claim:

1. A method for drawing up a special crude oil comprising the steps of:

(1) mixing an extractant oil with a crude oil selected from the group consisting of crude oils containing a great deal of wax and high viscosity crude oils which have been drawn up from an oil well to extract a gas oil therefrom;

(2) separating the mixture from step (1) into:

(a) a mixture of gas oil and an extractant oil; and (b) a heavy oil;

(3) separating mixture (a) obtained in step (2) into an extractant oil fraction and a gas oil fraction and injecting a part of the separated gas oil into the oil well; and (4) recycling the extractant oil obtained from step (3) into the extractant oil of step (1).

2. The method of claim 1 wherein the amount of extractant oil mixed with the crude is 0.05 to 12 times as much as the amount of a special crude oil drawn up.

3. The method of claim 1 wherein the pressure is maintained between 0 and 200 kg/cm$^2$ G and the temperature is kept between 0° and 450° C. in step 2).

4. The method of claim 1 wherein the temperature in step (3) is maintained higher than the temperature in step (2).

5. The method of claim 1 wherein said extractant is selected from the group consisting of aromatic hydrocarbons whose normal boiling point is 150° C. or less, straight-chain hydrocarbons with 3 to 9 carbon atoms, and monoolefin hydrocarbons with 4 to 8 carbon atoms.

* * * * *